United States Patent [19]

Celestina et al.

[11] Patent Number: 5,060,327

[45] Date of Patent: Oct. 29, 1991

[54] LABOR GRIPS FOR BIRTHING BED

[75] Inventors: Mary A. Celestina, Cincinnati, Ohio; David W. Williams, Batesville, Ind.; David C. Newkirk, Fairfield, Ohio

[73] Assignee: Hill-Rom Company, Inc., Batesville, Ind.

[21] Appl. No.: 599,434

[22] Filed: Oct. 18, 1990

[51] Int. Cl.[5] ..... A61G 7/00

[52] U.S. Cl. ..... 5/445; 5/60; 297/183; 269/328

[58] Field of Search ..... 5/60, 445, 508; 297/183, 466; 269/328, 325; 16/115, 119, 125

[56] References Cited

U.S. PATENT DOCUMENTS

| | | | |
|---|---|---|---|
| 2,585,660 | 2/1952 | Kjos et al. | 5/445 |
| 3,286,283 | 11/1966 | Bertoldo | 5/445 |
| 3,318,596 | 5/1967 | Herzog | 269/328 |
| 4,221,370 | 9/1980 | Redwine | 269/323 |
| 4,426,071 | 1/1984 | Klevstad | 269/328 X |
| 4,541,622 | 9/1985 | Tabuchi | 269/325 |
| 4,703,975 | 11/1987 | Roberts et al. | 297/183 X |
| 4,715,592 | 12/1987 | Lewis | 269/328 |

*Primary Examiner*—Michael F. Trettel

*Attorney, Agent, or Firm*—Wood, Herron & Evans

[57] ABSTRACT

A birthing bed has a labor grip on each side. Each labor grip has a free end terminating in a triangular hand grip providing at least three gripping positions. The labor grip is pivotable between a vertical operative position and a horizontal storage position.

10 Claims, 4 Drawing Sheets

LABOR GRIPS FOR BIRTHING BED

BACKGROUND OF THE INVENTION

This invention relates to a birthing bed and particularly the invention relates to a labor grip for a birthing bed.

During the birth of the baby, it is important for the mother to assume a comfortable attitude while at the same time assisting, through the exertion of abdominal muscle contraction, the thrusting of the baby out of her vagina. To this end, birthing beds have been provided with a handle on each side of the bed in a position that it can be gripped by the mother to assist her in creating maximum thrust. Such handles conventionally have a fixed position as, for example, depending from the forward end of the bed side guard.

The fixed single position handles suffer the disadvantage that they cannot comfortably be reached by different sizes and shapes of mothers.

It has been an objective of the present invention to provide a handle that provides multiple hand positions so as to provide mothers of different sizes and shapes the most comfortable gripping position as well as the capability of shifting from position to position to provide relief from laboring at one hand grip position.

The objective of the invention is attained by providing a vertical post mounted to the bed frame, the vertical post having a free upper end. To the free upper end a generally triangular gripping element is integrally mounted, the length of the three sides of the triangular gripping element being such as to provide room for even quite large size hands to grip around any of the three sides and the corners are rounded. Thus, the mother can grip all around the perimeter of the triangular element and can grip the post as well. The triangular element provides, for gripping, three major bars at differing angular positions and the post provides even a fourth bar.

For maximum effectiveness, the post and gripping element project perpendicularly from the frame into a position of prominence. There, the gripping surfaces are easily reached and gripped by the mother. It is a further important feature of the present invention to provide for pivoting the post totally out of the way under the bedframe so that when not needed it does not obstruct other operations of the birthing procedure.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
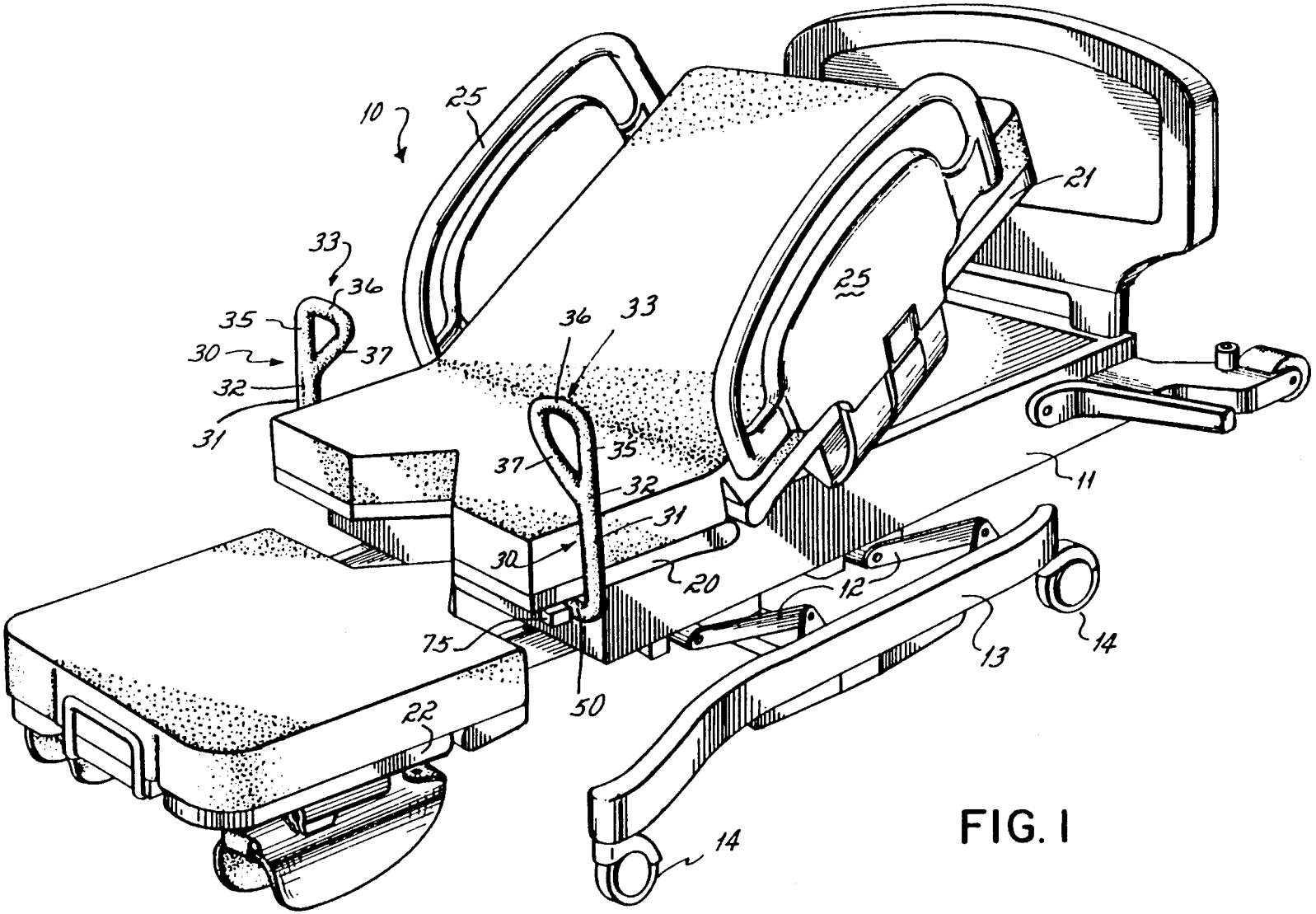
FIG. 1 is a perspective view of a birthing bed showing the bed and post in an operative position.
Figure 2:
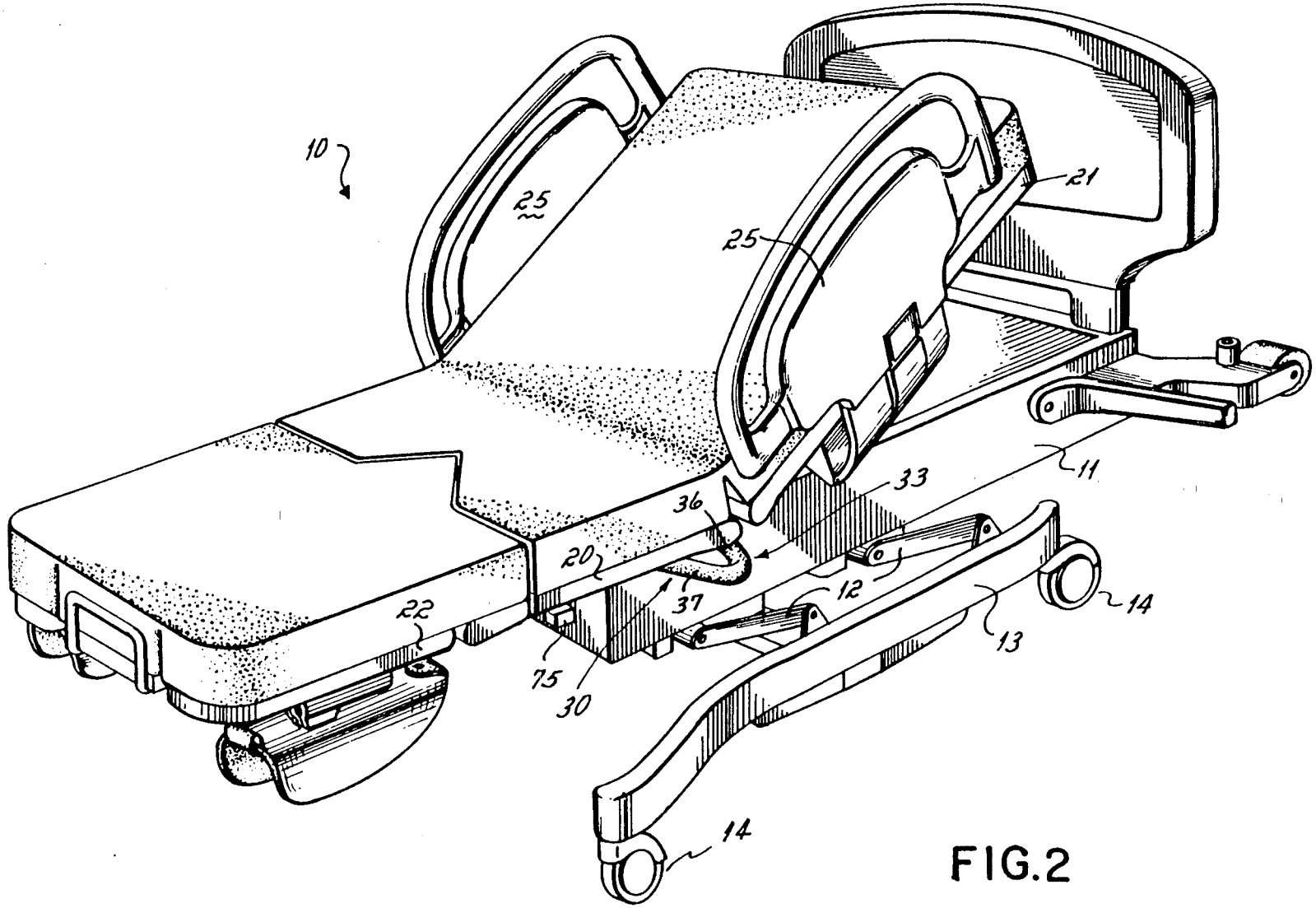
FIG. 2 is a view similar to FIG. 1 showing the labor grip post in a stored position.

Referring to FIG. 1, a birthing bed 10 is shown as having a main frame 11 mounted by a parallelogram linkage 12 to a base frame 13 having casters 14 for the support of the bed on the floor. The bed has a body support consisting of a seat panel 20 that is rigidly fixed to the frame and forms a part of the main frame 11. A head panel 21 is pivoted to the main frame 11 and a foot panel 22 is both vertically movable and pivoted to the main frame so that the bed can be articulated between chair positions and reclined bed positions as well as an infinite number of intermediate positions. The head panels have side guards 25 mounted thereon to provide assurance that the patient will not inadvertently roll out of bed.

Mounted to the underside of the seat panel 20 and hence to the main frame is a labor grip 30 on each side of the bed. The labor grips are mirror images of each other and therefore only one will be described. Each labor grip has a normally vertical post 31 having a free end 32. The free end has an integral triangle or triangular element 33 terminating the free end. The triangular element has a vertical side 35 forming an extension of the post 31. A horizontal side 36 projects inwardly, that is, toward the center of the bed, as well as slightly toward the foot end of the bed. A third inclined side 37 extends from the end of the horizontal side 36 back to the post 31 at the point where the vertical side of the triangle begins. The post and triangle are made of a rigid metal and are covered by a padding of the type that is conventionally used on a steering wheel, for example, to provide a nice, warm feel.

Referring to FIGS. 3–7, at the opposite lower end of the post 31, an L-shaped arm 50 is integral with the post 31. A socket 55 is mounted on the underside of the seat panel 20 and projects at 45° in a forward direction toward the foot end of the bed and in a downward direction. The arm 50 has an end 56 that projects into the socket 55, the socket having a bore 57 therefor. The end 56 is rotatable in the socket to permit the labor grip to pivot between its stored and operative positions. A snap ring 58 secures the end 56 in the socket. The pivoting end has two detent-receiving recesses 60, 61 which are circumferentially-spaced from each other by about 180°. A detent 63 is slidable in a sleeve 64 integral with the socket 55. A bellcrank lever 66 is pivoted at 67 to a post 68 fixed on the underside of the seat panel 20. A spring 69 is connected at one end to the bellcrank lever at 70 and at the other end it is fixed to the underside of the seat panel 20 at 71. The bellcrank lever has an arm 72 that projects into a slot 73 in the detent 63 to cause the detent 63 to slide in and out of the recesses 60, 61. A handle 75 is fixed to the other end 76 of the bellcrank lever. The handle is used to manually pivot the bellcrank lever in order to release the detent.

The L-shaped configuration of the arm 50 by which the labor grip is pivotally mounted to the frame or seat panel is such that the labor grip has two principal positions. As shown in FIG. 4, the arm is in a vertical position projecting substantially perpendicularly from the seat panel 20. It is held in that position by the detent 63 entering the recess 61. The labor grip has a storage position shown in FIGS. 3, 5 and 6 to which it is swung by pivoting it about the socket 55, the arm being held in storage by detent 63 entering recess 60. In the storage position, the labor grip lies flush against the underside of the frame 20 completely out of the way of any of the other operations attending the birthing process.

In the operation of the invention, after the mother is seated in the birthing bed with the head panel 21 raised to a seating position, and labor has begun, the labor grips 30 are raised to the vertical position shown in FIG. 1. The mother can reach any of the sides 35, 36, 37 of the triangle 33. A woman with long arms might be more comfortable reaching for the side 35 or even the post 31. In another instance, a mother might be more comfortable gripping the inside-inclined side 37 to assume a "row your boat" position to create a "C" or arched back.

The labor grips may also be used for foot stirrups to provide maximum exposure, although the birthing bed provides footrests slightly farther toward the foot end of the bed.

Figure 3:
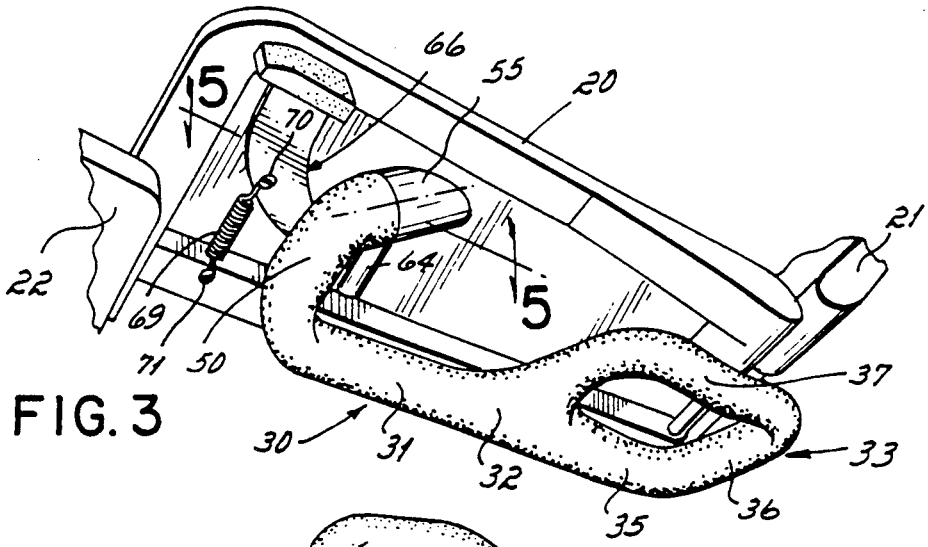
FIG. 3 is a perspective view taken from the underside of the frame showing a labor grip in stored position.
Figure 4:
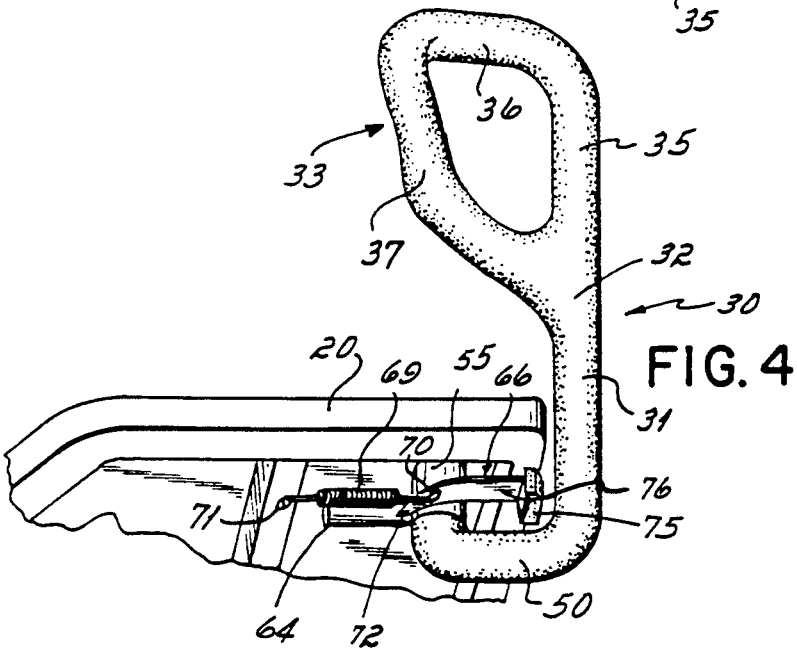
FIG. 4 is a perspective view taken from the underside of the frame showing a labor grip in a vertical operative position.
Figure 5:
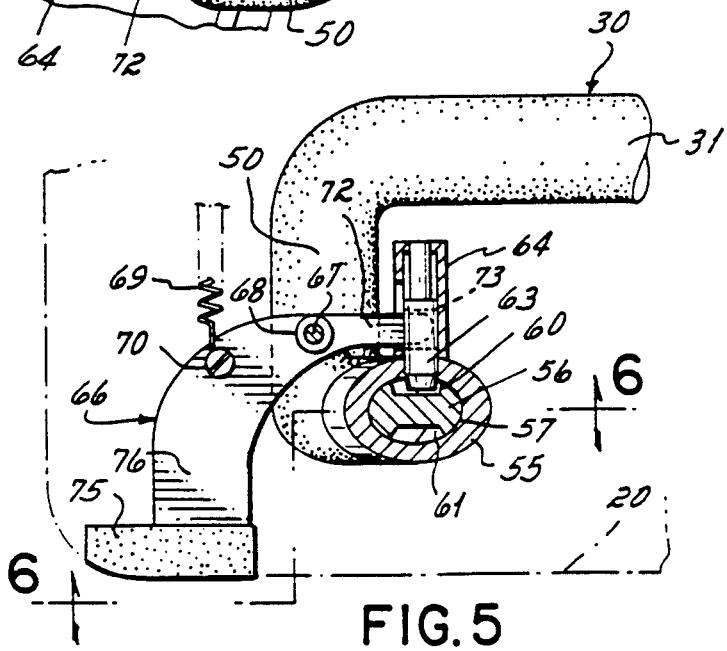
FIG. 5 is a cross-sectional view taken along lines 5—5 of FIG. 3.
Figure 6:
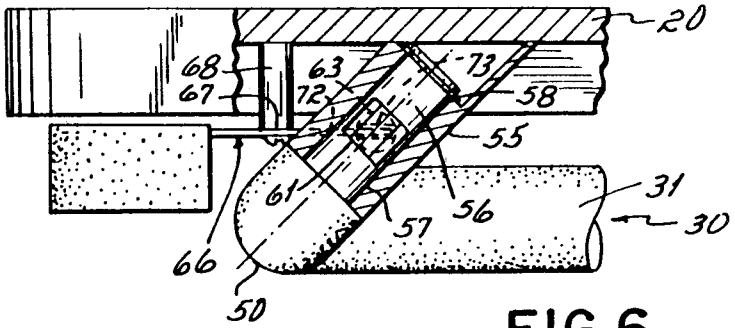
FIG. 6 is a cross-sectional view taken along lines 6—6 of FIG. 5.
Figure 7:
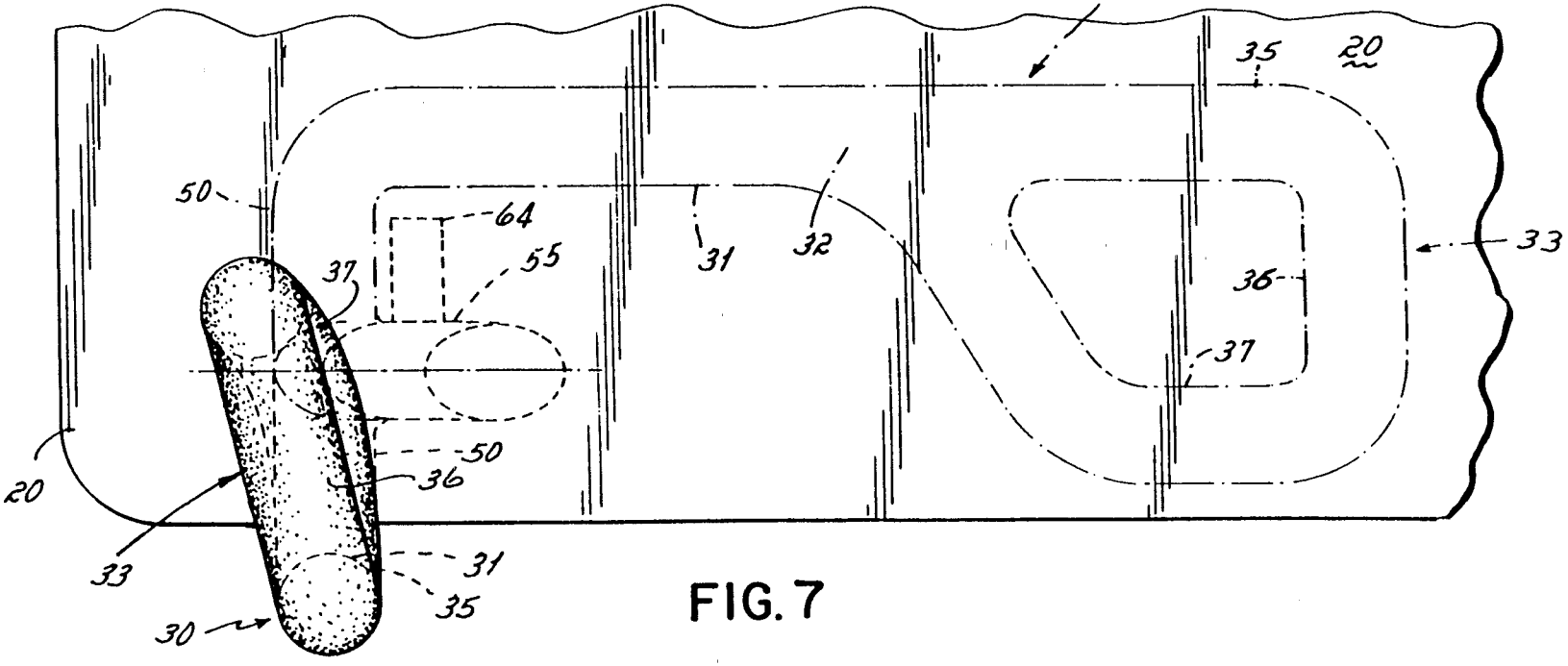
FIG. 7 is a fragmentary top plan view of the birthing bed showing the labor grip from the top.

When no longer in use, the handle 75 is manipulated to pull the detent 63 out of the recess 61 and the labor grips are swung to the position illustrated in FIG. 3 underneath the seat panel 20. The entry of the detent 63 into the recess 60 holds the labor grip in that position.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. In a birthing bed having a main frame and a patient support mounted on said main frame, a labor grip on each side of said main frame comprising:

a normally vertical post mounted on said frame, and a triangular hand grip integral with the end of said post, said hand grip having three interconnected sides presenting at least three different hand grip positions for the laboring mother.

2. A labor grip as in claim 1 further comprising:

a pivot shaft integral with said post, means pivotally mounting said pivot shaft on said frame for movements that swing said post between a vertical operative position and a horizontal storage position under said frame.

3. A labor grip as in claim 2 in which said mounting means comprises:

a socket mounted on said frame and having a bore, said socket having a radial hole extending into said bore, said pivot shaft projecting into said bore and having two circumferentially-shaped recesses that are respectively alignable with said hole when said labor grip is in each of its two positions, and a latching detent mounted on said frame and projecting into said hole to engage one of said recesses to hold said labor grip in one of its two positions.

4. A labor grip as in claim 3 further comprising:

a spring biasing said detent toward said recesses, and a handle mounted on said detent to move said detent temporarily out of said recess to permit said grip to swing between its two positions.

5. A labor grip as in claim 1 in which said triangular grip has a vertical side which is an extension of said post, a horizontal side extending inwardly from said vertical side, and an inclined side extending between the inner end of said horizontal side and the lower end of said vertical side.

6. A labor grip as in claim 5 in which said horizontal side extends slightly toward the foot end of said bed.

7. In a birthing bed having a main frame and a patient support mounted on said main frame, a labor grip on each side of said main frame comprising:

a post having a free end, a hand grip mounted on said free end, and means for mounting said post on said frame for movement between a vertical operational position and a horizontal stored position below said main frame.

8. A labor grip as in claim 7 further comprising:

releasable means for latching said post in each of its two positions.

9. A labor grip as in claim 8 in which said mounting means comprises:

a socket projecting downwardly and forwardly at an angle of 45° from the underside of said frame, and an L-shaped arm having one end integral with said post and the other end rotatably mounted in said socket.

10. A labor grip as in claim 8 wherein the end of said arm that is in said socket has two circumferentially-spaced recesses, and a spring-biased detent operable to project into said recesses to releasably latch said post in two positions.

* * * * *